United States Patent [19]

Kai et al.

[11] Patent Number: 5,033,603

[45] Date of Patent: Jul. 23, 1991

[54] COIN DIAMETER DISCRIMINATING DEVICE

[75] Inventors: Osamu Kai; Toshiharu Morihisa; Yasuyuki Inomata, all of Tokyo, Japan

[73] Assignee: Tamura Electric Works, Ltd., Japan

[21] Appl. No.: 428,611

[22] Filed: Oct. 30, 1989

[30] Foreign Application Priority Data

Nov. 2, 1988 [JP] Japan ..... 63-276118

[51] Int. Cl.[5] ..... G07D 5/02

[52] U.S. Cl. ..... 194/334; 250/223 R

[58] Field of Search ..... 194/334, 317, 318; 250/223 R

[56] References Cited

U.S. PATENT DOCUMENTS 4,585,936 4/1986 Sellier ..... 194/334 X
4,646,904 3/1987 Hoormann ..... 194/334
4,660,705 4/1987 Osamu Kai et al. ..... 194/318
4,667,093 5/1987 MacDonald ..... 194/334 X
4,848,556 7/1989 Shah et al. ..... 194/334 X

*Primary Examiner*—F. J. Bartuska
*Attorney, Agent, or Firm*—Remy J. VanOphem

[57] ABSTRACT

A coin diameter discriminating device includes a plurality of optical sensors, a measuring section, and a calculating section, and a discriminating section. The plurality of optical sensors are arranged along the coin path so as to be separated from each other in a direction to cross a coin rolling direction and to oppose different positions of a coin which rolls downs. The measuring section measures a detection time of the coin on the basis of outputs from the optical sensors. The calculating section calculates a ratio of the detection times of two specific optical sensors which are supplied from the measuring section. The discriminating section discriminates a diameter of the inserted coin on the basis of a calculation result from the calculating section.

7 Claims, 8 Drawing Sheets

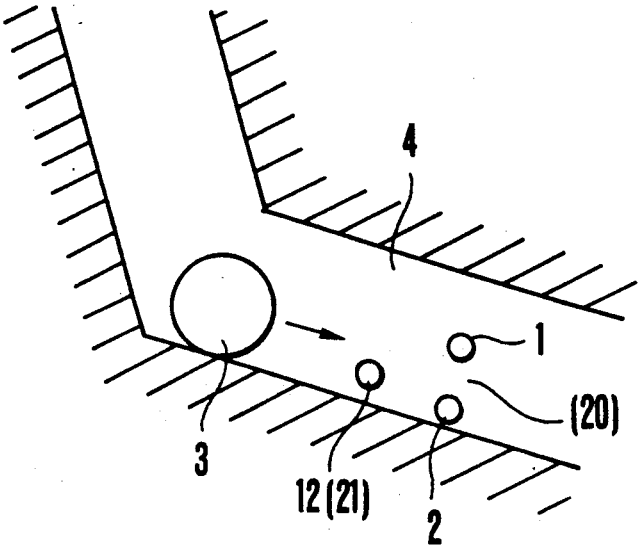
FIG.2
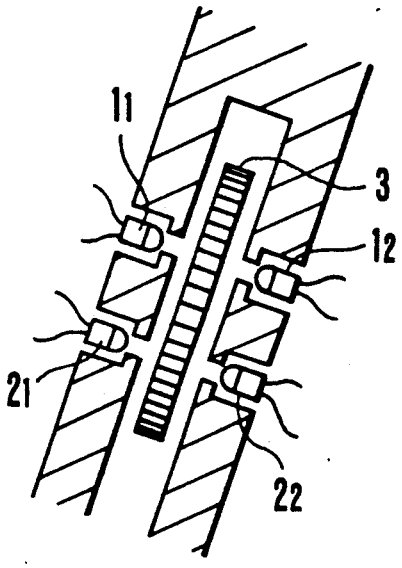
FIG.3
FIG.5A
FIG.5B
FIG.5C
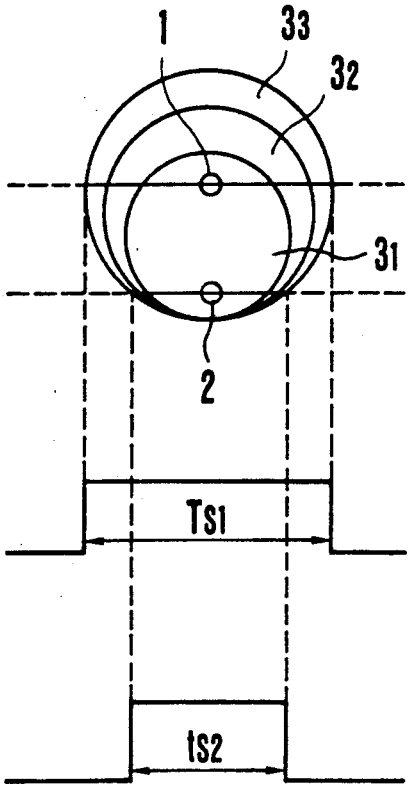

COIN DIAMETER DISCRIMINATING DEVICE

BACKGROUND OF THE INVENTION

The present invention relates to a coin diameter discriminating device for discriminating the diameters of coins inserted in a public telephone or the like.

In a conventional method, a coin discriminating device used for, e.g., a public telephone, employs coils for coin material and thickness discrimination so as to discriminate the physical characteristics of coins. In this method, however, since diameter data of coins cannot be obtained, coins consisting of the same material and having different diameters cannot be discriminated. Japanese Patent Laid-Open No. 54-41766, therefore, discloses a device in which optical sensors ar arranged to be separated from each other in the rolling direction of coins. This device discriminates the diameter of a coin on the basis of the time during which light emitted from each optical sensor is shielded by the coin passing therethrough.

In such a conventional device, however, two different optical sensors need to be arranged in the rolling direction of coins. Since the speed of a coin is higher at the instant when passing through the second sensor than the instant when passing through the first sensor, an error due to variations in diameters of coins cannot be prevented. In addition, since at least two types of sensors must be arranged in the rolling direction of coins, the distance required for discrimination cannot be satisfactorily shortened, thereby posing a problem in terms of compactness.

SUMMARY OF THE INVENTION

It is, therefore, a principal object of the present invention to provide a coin diameter discriminating device in which no error is caused by changes in rolling speed and the distance required for discrimination can be shortened to realize a compact arrangement.

It is another object of the present invention to provide a coin diameter discriminating device which can increase discrimination precision.

It is still another object of the present invention to provide a coin diameter discriminating device which can discriminate coin denominations and authentic coins.

It is still another object of the present invention to provide a coin diameter discriminating device in which the arrangement of a portion for converting a measurement signal into an address signal can be simplified.

It is still another object to provide a coin diameter discriminating device in which optical sensors can be driven with low power so as to ensure power for other control systems.

In order to achieve the above objects, according to the present invention there is provided a coin diameter discriminating device, having an optical sensor arranged in a coin path on which an inserted coin rolls down, for discriminating a diameter of the coin on the basis of an output from the optical sensor. The device includes a plurality of optical sensors arranged along the coin path so as to be separated from each other in a direction to cross a coin rolling direction and to oppose different positions of the coin which rolls downs, measuring means for measuring a detection time of the coin on the basis of outputs from the optical sensors, calculating means for calculating a ratio of detection times of two specific optical sensors which are supplied from the measuring means, and discriminating means for discriminating a diameter of the inserted coin on the basis of a calculation result from the calculating means.

When a coin rolls, light from each sensor is shielded within a time during which the radius of the coin passes therethrough. This shielding is released with the progress in rolling of the coin. In this case, the time during which the light from the sensor is shielded varies depending on a positional relationship between each sensor and a portion at which the circumferential surface of the coin is in contact with a coin path. Therefore, the diameter of the coin can be discriminated on the basis of the shielding time ratio.

BRIEF DESCRIPTION OF THE DRAWINGS

FIG. 2 is a view showing an arrangement of sensors in a coin rolling path of the device in FIG. 1;

FIG. 3 is a sectional view showing a detailed arrangement of the sensors attached to the service;

FIGS. 5A to 5C are views for explaining relative positions of a coin and the sensors;

DETAILED DESCRIPTION OF THE PREFERRED EMBODIMENT

Figure 1:
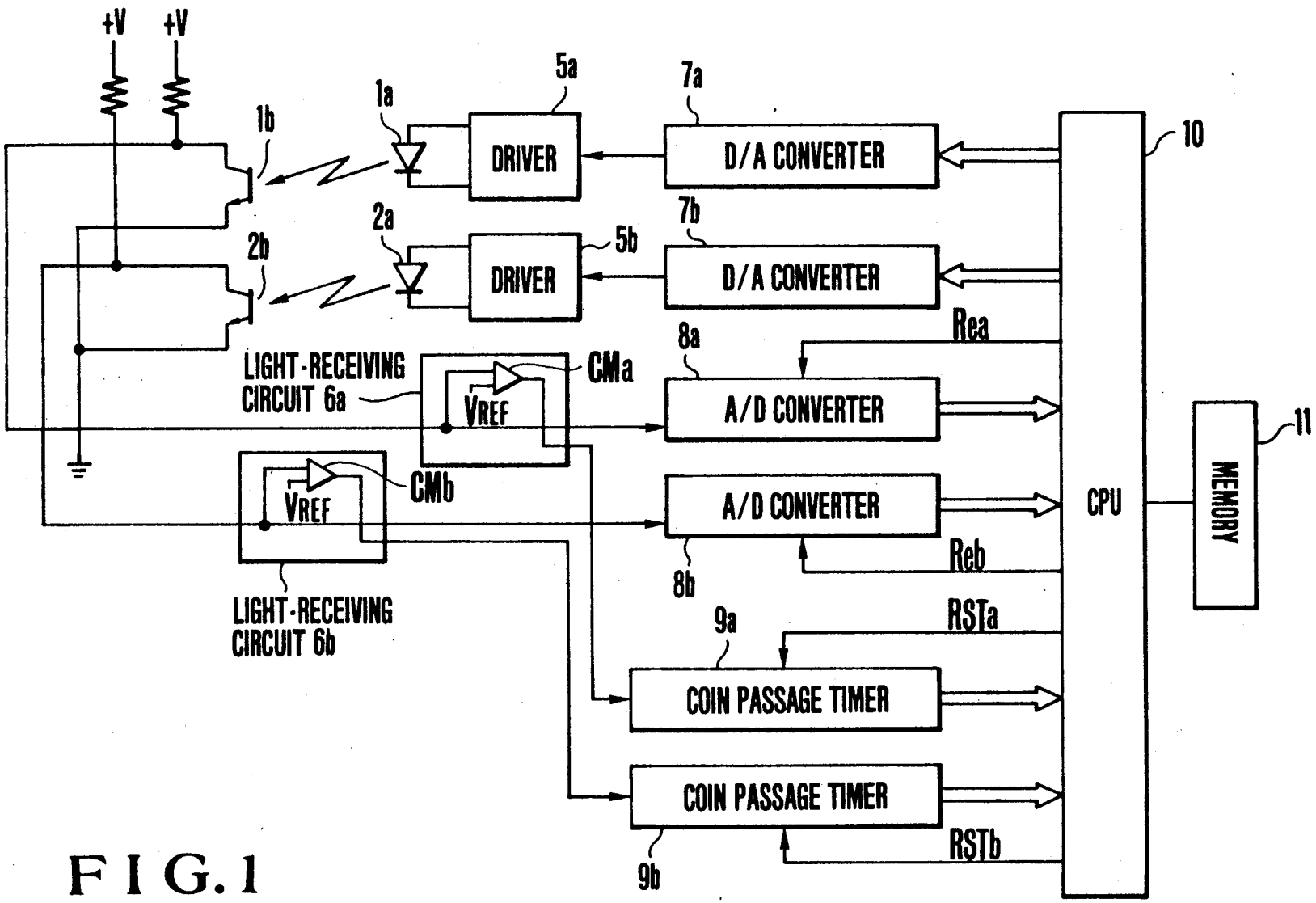
FIG. 1 is a block diagram showing an arrangement of a device according to an embodiment of the present invention

FIG. 1 shows a device according to the present invention Referring to FIG. 1, reference numerals 1 and 2 denote optical sensors respectively consisting of light emitting diodes 1*a* and 2*a* and phototransistors 1*b* and 2*b*. These sensors are arranged in a direction to cross a coin rolling path 4 through which a coin 3 rolls down, e.g., in a direction perpendicular to the path 4, as shown in FIG. 2. FIG. 3 shows detailed mounting states of the sensors. In this arrangement, only while the optical paths of the two optical sensors are shielded by the coin 3, no output signal is generated. The optical sensors 1 and 2 are placed at positions where light beams from both the sensors are shielded by a coin 3 having the smallest size.

Reference numerals 5*a* and 5*b* denote drivers for driving the light emitting diodes; 6*a* and 6*b*, light-receiving circuits for receiving output signals from the phototransistors; 7*a* and 7*b*, D/A converters; 8*a* and 8*b*, A/D converters; 9*a* and 9*b*, coin passage timers; 10, a CPU; and 11, a memory constituted by a ROM, a RAM, and the like. Note that the A/D converters 8*a* and 8*b* supply outputs t the CPU 10 in accordance with signals Rea and Reb from the CPU 10.

Reset signals RSTa and RSTb are respectively supplied to the coin passage timers 9a and 9b to reset the timers 9a and 9b. The supply timing of these reset signals coincides with the timing at which an insertion sensor (to be described later) detects coin insertion.

The light-receiving circuits 6a and 6b respectively include comparators CMa and CMb for respectively comparing a reference signal $V_{REF}$ with outputs from the phototransistors 1b and 2b. Outputs from the circuits 6a and 6b are respectively supplied as pulses to the coin passage timers 9a and 9b.

In addition, the light-receiving circuits 6a and 6b are designed to directly supply outputs from the phototransistors 1b and 2b to the A/D converters 8a and 8b, respectively.

Note that the collectors of the phototransistors 1b and 2b are connected to a power source +V through resistors.

Referring to FIG. 2, reference numeral 12 denotes an optical sensor having the same arrangement as that of the optical sensor 1 or 2. The sensor 12 serves as a coin insertion sensor for detecting insertion of a coin, whereas the optical sensors 1 and 2 serve as diameter sensors for detecting the diameter of a coin (the optical sensors 1 and 2 will be generally referred to as a diameter sensor 20; and the optical sensor, an insertion sensor 21.) Note that a driver and a light-receiving circuit for the insertion sensor 21 are omitted from FIG. 1.

Figure 4:
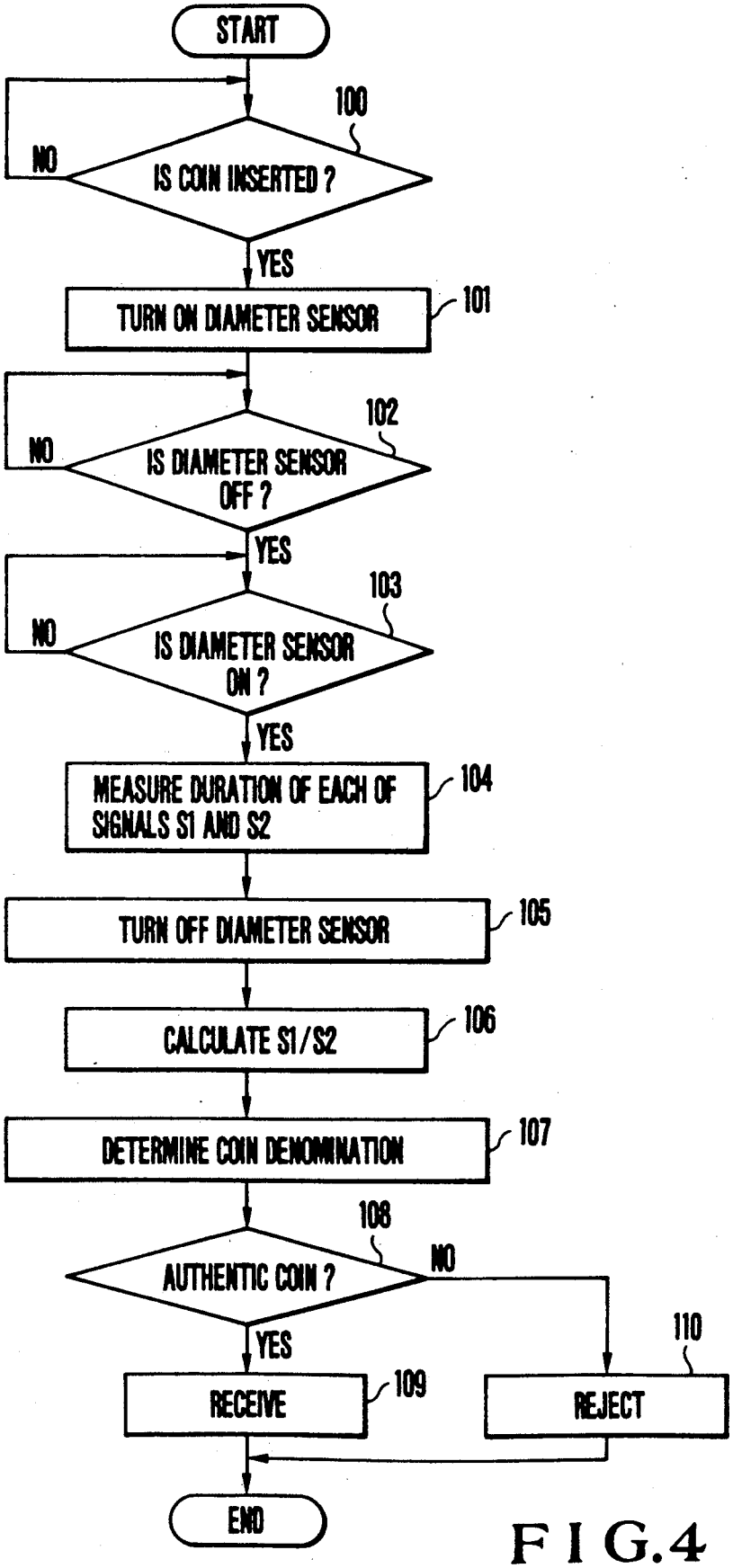
FIG. 4 is a flow chart showing an operation of the device in FIG. 1.

FIG. 4 is a flow chart for explaining an operation of the device having the above-described arrangement. Referring to FIG. 4, when coin insertion is detected by the insertion sensor 21 in step 100, the diameter sensor 20 is driven and turned on in step 101. When the coin 3 rolls down to the position of the diameter sensor 20, its optical path is shielded by the coin 3. As a result, the diameter sensor 20 is turned off in step 102. When the coin 3 rolls further, shielding of the optical path by the coin 3 is released, and the diameter sensor 20 is turned on in step 103.

In this case, signals are generated from the diameter sensor 20 in a state shown in FIG. 5A. More specifically, the optical sensors 1 and 2 constituting the diameter sensor 20 are respectively placed at positions shown in FIG. 5A so as to allow a coin $3_1$ having the smallest diameter (among coins $3_1$, $3_2$, and $3_3$ usable for the device) to shield the optical paths of both the sensors 1 and 2. The time during which each optical path is shielded depends on how far the position of a corresponding sensor is separated from the center of the coin 3. For example, if the coin $3_3$ is exemplified in FIGS. 5A to 5C, the time during which the optical path of the sensor 1 is shielded is time $T_{S1}$ as shown in FIG. 5B whereas the shielding time with respect to the sensor 2 is time $t_{S2}$ as shown in FIG. 5C. That is, the shielding time is increased as the position of a sensor approaches the center of a coin. In practice, therefore, optical sensors are positioned to set a maximum ratio of shielding times of usable coins. Signals which are output when the optical paths of the optical sensors 1 and 2 are shielded respectively denoted by reference symbols S1 and S2.

An operation of the device will be described again with reference to the flow chart In step 104, the duration of each of the signals S1 and S2 is measured by a measuring means for measuring the detection time of a coin on the basis of signals supplied to the CPU 10. In step 105, the diameter sensor 20 is turned off. The operation in step 105 is performed to stop power consumption in the circuits associated with the diameter sensor 20 in the subsequent steps, thereby reducing the power consumption.

In step 106, a calculation of S1/S2 as the ratio of the signal S1 to the signal S2 is performed The ratio of the signal S1 to the signal S2 falls within a predetermined range which is determined for each usable coin. In step 107, a coin denomination is determined on the basis of the calculated value In step 108, it is checked whether the coin is authentic. If YES in step 108, the coin is received in step 109 If NO in step 108, the coin is rejected in step 110.

Figure 6:
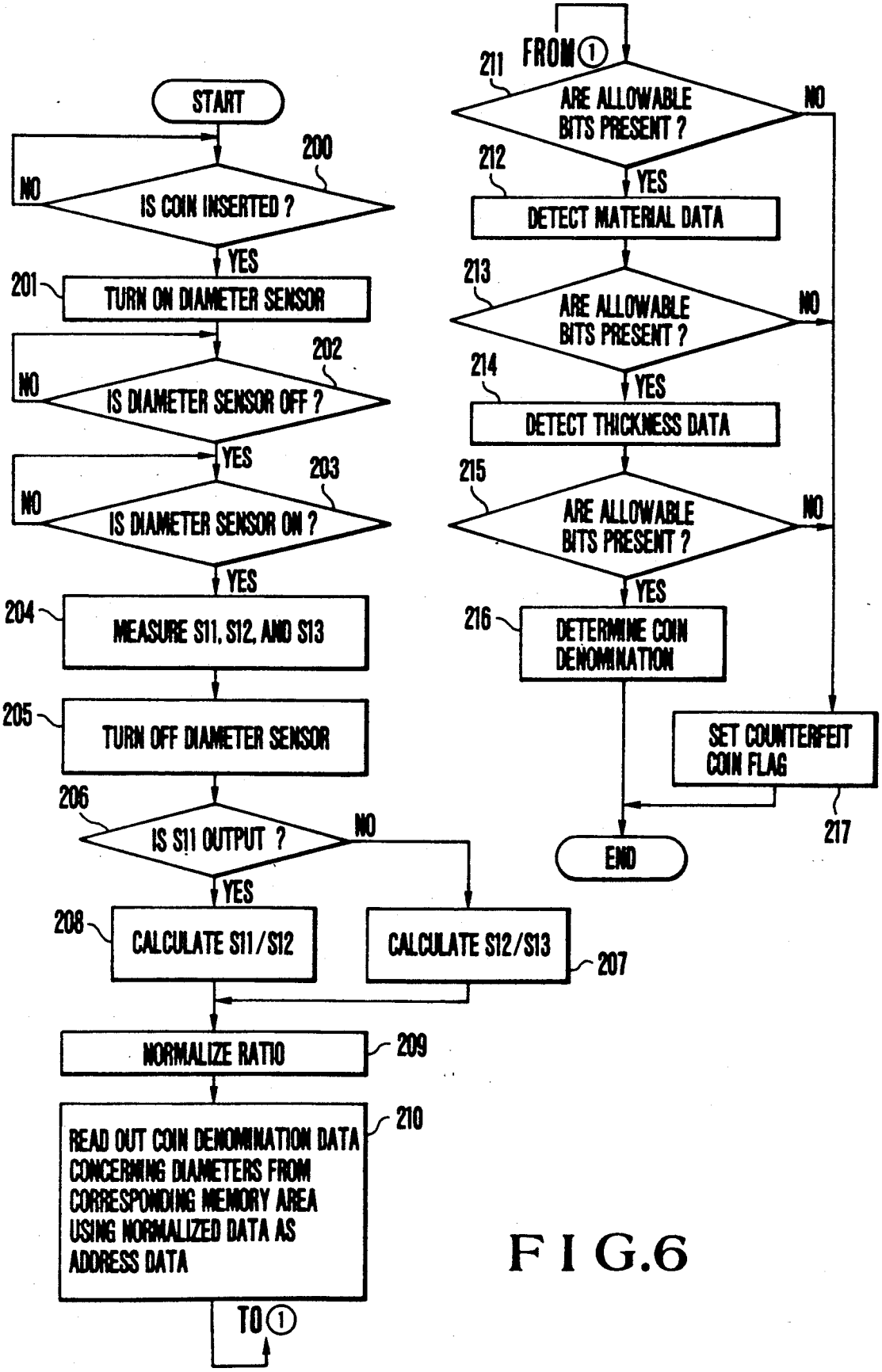
FIG. 6 is a flow chart for explaining an operation of a device according to another embodiment of the present invention.
Figure 7:
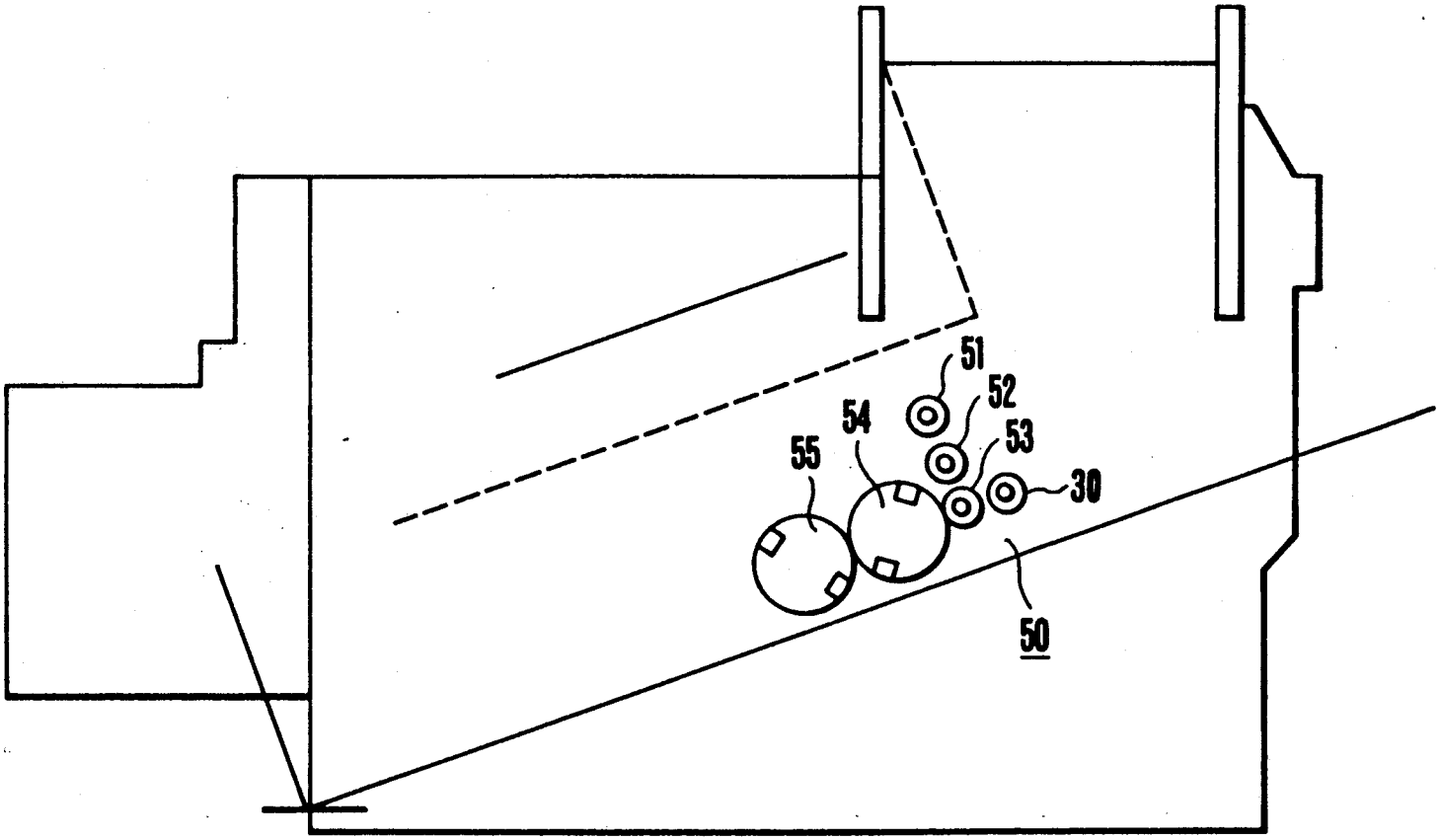
FIG. 7 is a view showing mounting states of sensors used in the device in FIG. 6.

FIG. 6 is a flow chart showing an operation of a device according to another embodiment of the present invention. FIG. 7 shows the mounting positions of sensors used in this embodiment. Similar to the device in FIG. 2, the device in FIG. 7 includes an insertion sensor 30 and a diameter sensor 50. In addition, the device also has a material sensor 54 behind the diameter sensor 50, and a thickness sensor 55 behind the sensor 54. The diameter sensor 50 includes three optical sensors 51, 52, and 53. The sensors 52 and 53 are arranged at positions which are determined on the same basis as that in FIG. 2. The optical sensor 51 is positioned so as to maximize a ratio of output signals from the optical sensors 51 and 52 with respect to usable coins except for the smallest one. An operation of the device will be described below with reference to FIG. 6 in which reference symbol S11 denotes a signal which is output when the uppermost optical sensor 51 is shielded by a coin 3; S12, a signal which is output when the optical sensor 52 located below the sensor 51 is shielded; and S13, a signal which is output when the lowermost optical sensor 53 is shielded.

In FIG. 6, the operations in steps 200 to 205 are the same as those in FIG. 1 except that signals S11, S12, and S13 are used in place of signals S1 and S2. After the sensors are turned off in step 205, it is checked in step 206 whether the signal S11 is output. If NO in step 206, i.e., if the uppermost optical sensor 51 outputs no signal, a calculation of S12/S13 as the ratio of output signals from the two optical sensors 52 and 53 located below the sensor 51 is performed in step 207. If YES in step 206, i.e., if the uppermost optical sensor 51 outputs a signal, a calculation of S11/S12 as the ratio of output signals from the uppermost optical sensor 51 and the optical sensor 52 located therebelow is performed in step 208.

Subsequently, in step 209, the calculated ratio is normalized, i e., address data corresponding to the ratio is formed. In step 210, the address data is supplied to the memory 11 in FIG. 1 so as to read out coin denomination data associated with a diameter therefrom. In this case, memory areas to be read-accessed are different depending on whether the flow advances through step 207 or 208. The CPU 10 determines a memory area to be read-accessed in accordance with data representing that a ratio calculation is performed in step 207 or 208. More specifically, when normalization is performed in step 209, different bits are added to address signals depending on whether a calculation is performed in step 207 or 208.

As described above, coin denomination data associated with a diameter is read out from the memory 11 to which address data is supplied. This data is constituted by, e.g., 8 bits, and a specific logical value "0" is stored in a specific bit for each coin type. Assume that "01011111" is read out in response to a given address signal. The position of "0" as the most significant bit of this data is defined as a bit b7; and the position of "1" as the least significant bit, a bit b0. In this case, bits b5 to b7 are assigned to coin type data. The bit b5 corresponds to a coin denomination A; the bit b6, a coin type B; and the bit b7, a coin denomination C. Of the bits b5 to b7, a bit in which "0" is stored is defined as an allowable bit. In the readout data, allowable bits associated with diameters are present with respect to both the coin denominations A and C. In this case, the data is read out from the memory by using the address data normalized on the basis of the calculation result However, calculation results even for authentic coins vary slightly. For this reason, the above-described data is stored in the memory 11 in consideration of the variation. More specifically, the data "01011111" is stored in all the areas corresponding to address signals which fall within an allowable variation range. For this reason, within the allowable range of an address signal in which a corresponding coin is determined to be authentic, the same data is read out and is subjected to determination under the same conditions.

In step 211, it is checked whether any allowable bits are present in the coin denomination data. In this case, since allowable bits are present with respect to the coin denominations A and C, YES is obtained in step 211. As a result, material data from the material sensor 54 is detected in step 212. The detected data is converted into an address signal and is supplied to a material data storage area of the memory 11, thus reading out coin denomination data associated with a material. For example, if "00111111" is read out as data associated with a material, it is checked in step 213 whether any allowable bits are present. It is determined that the data has allowable bits associated with materials with respect to the coin denominations B and C.

When the coin rolls further, thickness detecting data from the thickness sensor 55 is detected in step 214, and the presence/absence of allowable bits is checked in step 215. If, for example, data "00111111" is read out, the data has allowable bits associated with thickness with respect to the coin denominations B and C.

If NO is obtained in any one of steps 211, 213, and 215, a counterfeit coin flag is set in step 217. If YES is obtained in all the steps described above, a coin type is determined in step 216. In this case, the coins A and C are determined to be authentic in association with diameters; the coins B and C, in association with materials; and the coins B and C, in association with thickness. Only the coin C is determined to be authentic in association with the three conditions for authentic coins. Therefore, the coin which was inserted in step 216 is determined to be authentic, and its coin denomination is determined to be of the coin C.

As described above, in this embodiment, after step 211, measurement data is converted into address data, and required data is read out from the memory 11 in which allowable range data of authentic coins are written by using the address data, thus performing determination of an authentic coin and a coin denomination. Note the operations from steps 210 to 216 are described in detail in Japanese Patent Laid-Open No. 60-262292.

In this case, since a diameter is optically determined, diameter measurement is free from interference from other elements, and can be accurately performed. On the other hand, since the material and thickness are determined by using magnetism, relative interference is present. In order to reduce the influences of the interference, the diameter sensor needs to be spaced apart from other sensors by a certain distance. If the diameter sensor is reduced in size for this purpose, interference from the material and thickness sensors is increased to cause an error. However thickness data and material data are simultaneously obtained as data detected by magnetism. Therefore, if the data in the memory are set to correspond to the measurement results, a single sensor can be commonly used for detecting materials and thicknesses. Since a diameter can be accurately measured, even if a single sensor is commonly used for detecting materials and thicknesses, determination of an authentic coin can be performed with high precision.

A modification of the drive/control circuit used for an optical sensor will be described below with reference to the accompanying drawings.

Figure 8:
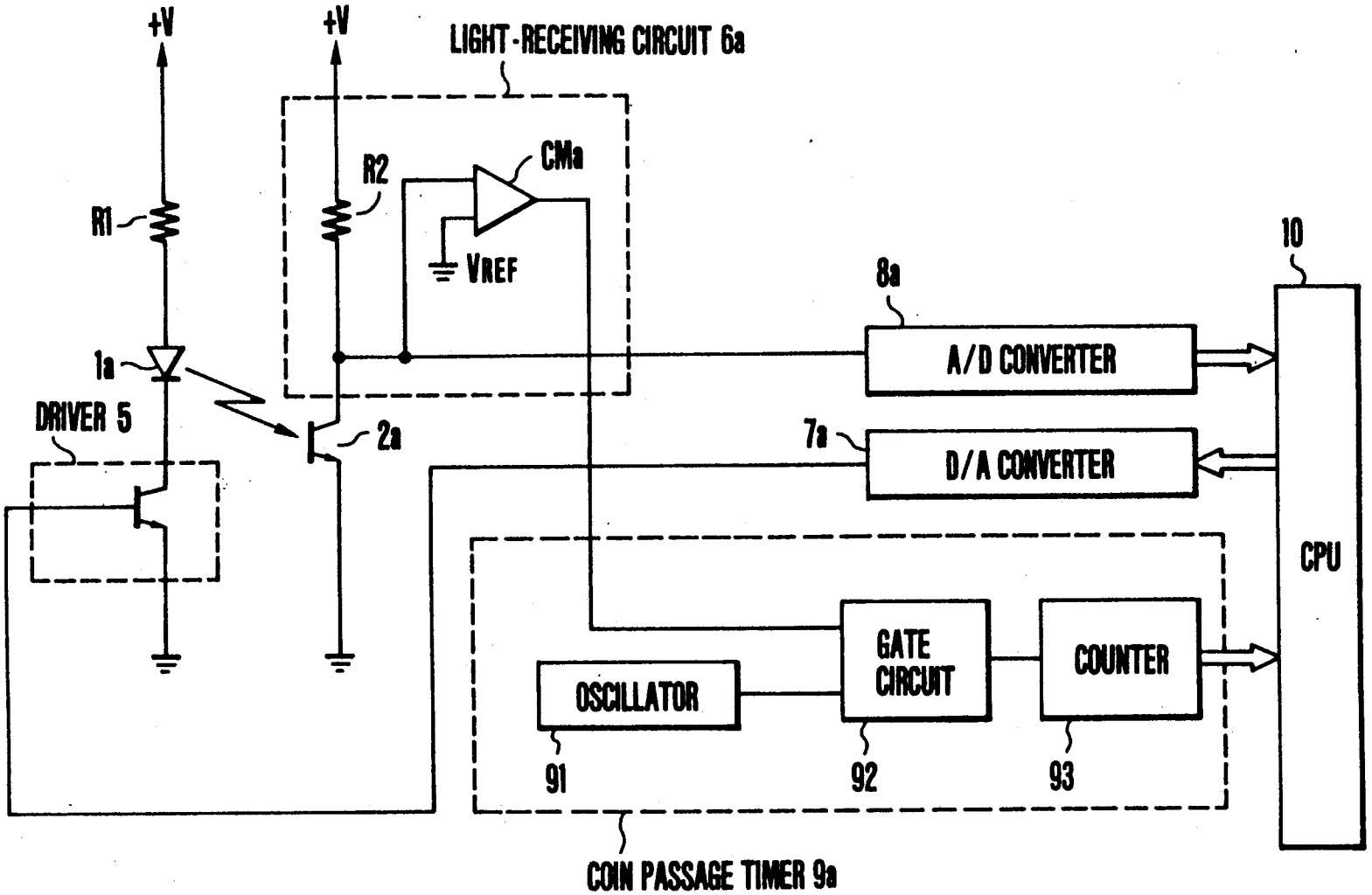
FIG. 8 is a block diagram showing an optical sensor drive/control circuit according to an embodiment of the present invention.

FIG. 8 shows an optical sensor drive/control circuit of another embodiment according to the present invention. The same reference numerals in FIG. 8 denote the same parts as in FIG. 1. FIG. 8 shows an optical sensor 1 as a typical optical sensor. Other optical sensors may have the same arrangement as that of the optical sensor 1. Note that since a driver 5 is constituted by only an npn transistor, reference numeral 5 also denotes a transistor in FIG. 8. The emitter of the the transistor 5 is grounded. The collector of transistor 5 is connected to a power source +V through a light-emitting element 1*a* and a resistor R1 In addition, in this embodiment, a light-receiving circuit 6*a* comprises a resistor R2 connected to the output side of a light-receiving element 2*a*, and a comparator CMa for comparing an output from the light-receiving element 2*a* with a reference signal $V_{REF}$ and generating a pulse output. The output from the light-receiving element 2*a* is also supplied to an A/D converter 8*a*. The above described arrangement is the same as that in FIG. 1. A coin passage timer 9*a* for receiving an output from the light-receiving circuit 6*a* comprises a comparator CMa, an oscillator 91, a gate circuit 92, and a counter 93. Note that this optical sensor is used to detect the diameter of an inserted coin.

Figure 9:
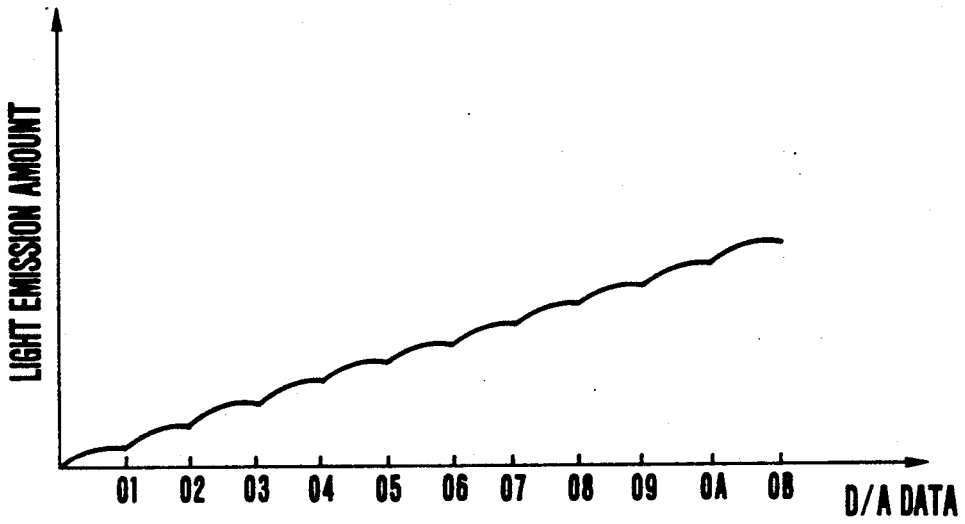
FIG. 9 is a graph showing a relationship between the value of a digital drive signal and the light emission amount.

When the power source of this coin discriminating device is turned on, a CPU 10 supplies a digital drive signal to a D/A converter 7*a* so as to drive the driver 5 and gradually increase the light emission amount of the light-emitting element 1*a*. The digital drive signal is then converted into an analog drive signal by the D/A converter 7*a* and is supplied to the base of the driver 5. The driver 5 drives the light-emitting element 1*a* in accordance with the analog drive signal as illustrated in FIG. 9. The light-emitting element la is driven to emit light as an optical signal. This optical signal is received by the light-receiving element 1*b* and is output as an analog output signal. This analog signal is then converted into a digital signal by an A/D converter 8*a* and is supplied to the CPU 10. Upon reception of this digital signal, the CPU 10 determines the value of this signal. When the value becomes equal to a predetermined value set in the CPU 10, the value of the digital drive signal is stored.

Subsequently, the stored digital drive signal is supplied to the D/A converter 7*a* to cause the light-emitting element 1*a* to emit light, thereby performing coin discrimination. More specifically, when an inserted coin passes through the optical sensor, i.e., between the light-emitting and -receiving elements 1*a* and 1*b*, the optical signal from the light-emitting element 1*a* is shielded. This shielding signal is generated only while a coin passes through the optical sensor. The shielding signal is supplied to the coin passage timer 9. Upon detection of an output signal from the timer 9, the CPU discriminates the diameter of the coin.

The shielding signal from the optical sensor is supplied to the gate circuit 92 through the comparator CMa, and the gate circuit 92 is turned on by this shielding signal. At this time, clock signals from the oscillator 91 are supplied to the counter 93 through the gate circuit 92 and are counted by the counter 93. While receiving and counting the clock signals, the counter 93 supplies an "H"-level signal to the CPU 10. As a result, the CPU 10 detects the "H"-level signal and discriminates the diameter of the inserted coin.

FIG. 9 shows a relationship between the value of D/A data (digital drive signal) supplied from the CPU 10 to the D/A converter *7a* and the light emission amount of the light-emitting element 1*a* to be driven by this data supply. Referring to FIG. 9, D/A data values 01 to (B respectively represent hexadecimal digital data values With an increase in D/A data value, the light emission amount of the light-emitting element 1*a* is increased.

Figure 10:
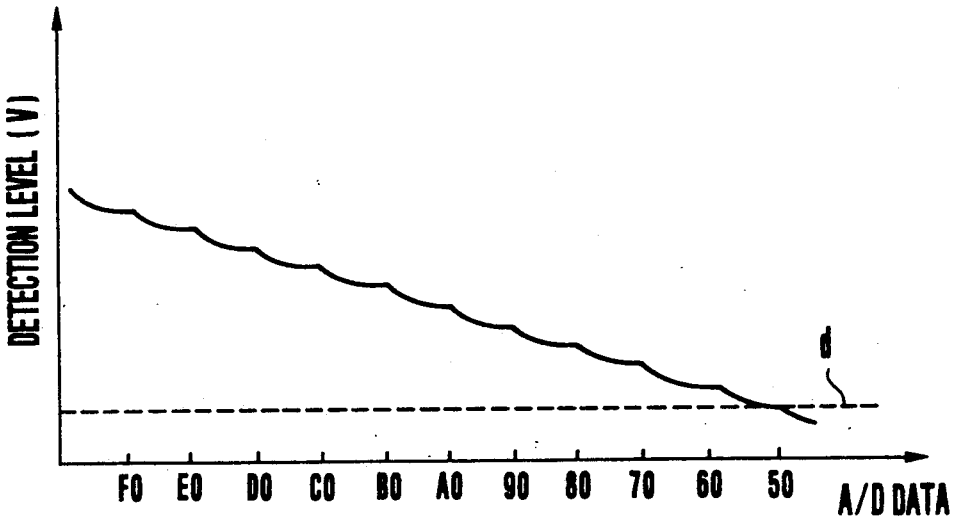
FIG. 10 is a graph showing a relationship between the value of a digital signal and the detection level.

FIG. 10 shows a relationship between a detection level (V: unit volt), i.e., an analog output from the light-receiving element 1*b* and the value of A/D data obtained by converting the analog output into a digital signal using the A/D converter 8*a*. Note that in FIG. 10, A/D data values F0 to 50 respectively represent hexadecimal digital data values, and a level b indicated by a dotted line represents a detectable level. At the detectable level, the value of A/D data is 50. This A/D data value, i.e., 50, indicates the operation limit of the optical sensor drive/control circuit. At this limit, the optical sensor drive/control circuit is operated with the minimum power.

Figure 11:
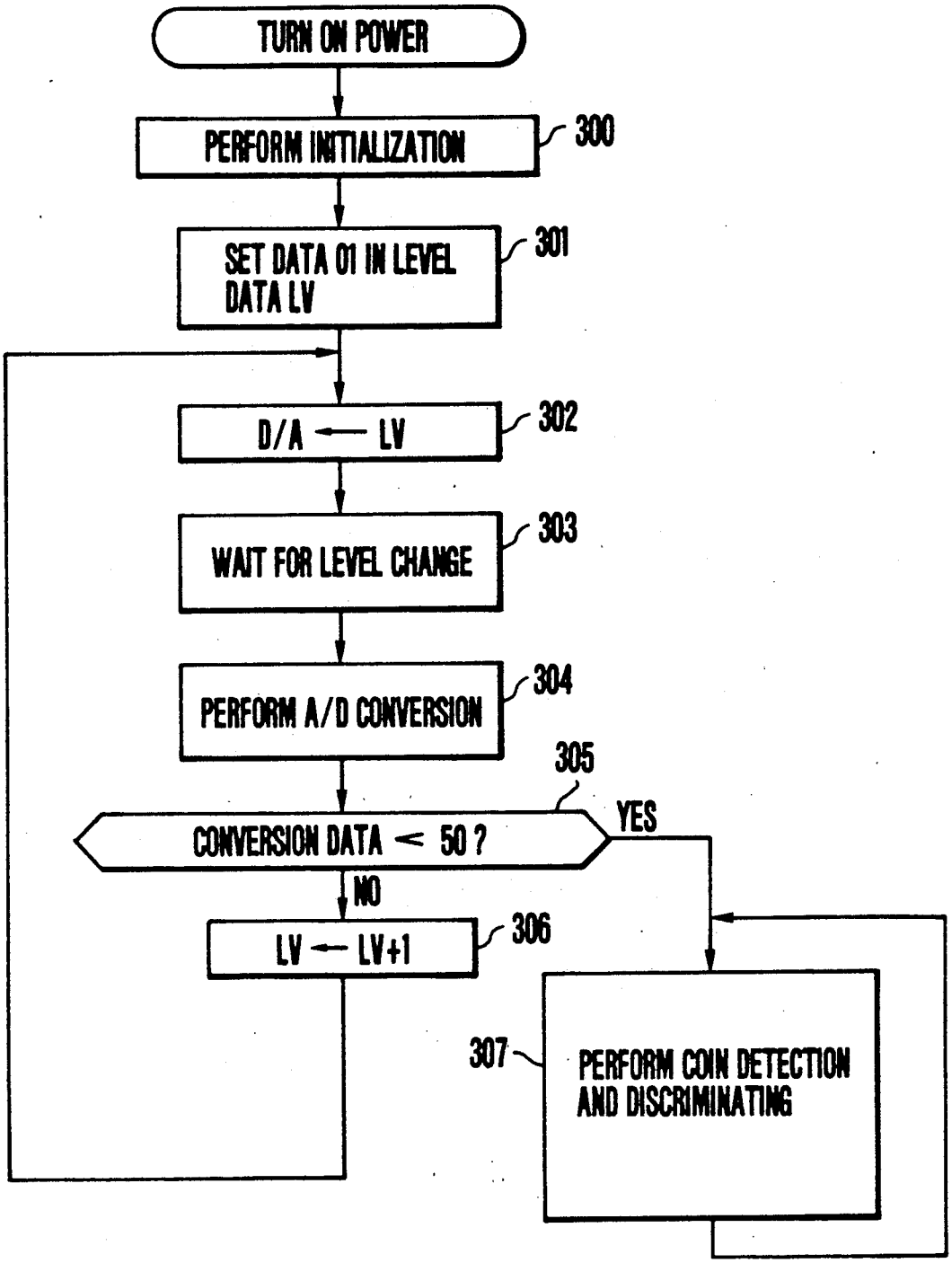
FIG. 11 is a flow chart for explaining an operation of the optical sensor drive/control circuit.

An operation of the optical sensor drive/control circuit having the above-described arrangement will be. described in detail below with reference to a flow chart shown in FIG. 11. After the circuit is energized, i.e., after the power switch is turned on, initialization is performed in step 300. In step 301, hexadecimal data 01 is set in a level data LV portion in the CPU 10. In step 302, the data set in the level data LV portion, i.e., the digital drive signal, is supplied to the D/A converter *7a* (digital drive signal generating means).

In step 303, the CPU 10 waits for a level change, i.e., for a time interval in which the driver 5 is turned on in response to the data supplied to the D/A converter *7a*, the light-emitting element 1*a* is driven to emit light as an optical signal, and the optical signal is transferred to the light-receiving element 1*b*. When this time interval has elapsed, an analog output signal from the light-receiving element 1*b* is converted into hexadecimal digital data by the A/D converter 8*a* in step 304. Upon reception of this data, the CPU 10 checks in step 305 whether the data is larger than a value of 50 set in the CPU 10 in advance (comparing means). If NO in step 305, i.e., if the data is smaller than 50, the data set in the level data LV portion is incremented by one. The flow then returns to step 302 to supply this addition data to the D/A converter *7a* again.

If Yes in step 305, i e., the input digital data is larger than 50, the data set in the level data LV portion, i.e., the value of the digital drive signal is stored, and the data is subsequently supplied to the D/A converter *7a*, thereby performing coin detection and coin discrimination in step 307.

In this manner, prior to coin detection and coin discrimination, a drive signal is gradually supplied to the driver 5 upon energization of the circuit, and the level of an output signal from the light-receiving element 1*b* is detected. When the level reaches a predetermined level, the value of the drive signal is stored, and the drive signal is subsequently supplied to the driver 5, thereby performing coin detection and coin discrimination.

In this embodiment, the light-emitting element 1*a* is controlled to gradually increase its light emission amount. However, a relatively large current may be supplied beforehand to the base of the driver (transistor) 5 for driving the light-emitting element la so as to increase the light emission amount, and the light-emitting element 1*a* is controlled to gradually decrease its light emission amount.

In addition, the present invention is not limited to a coin sensor of a public telephone and may be applied to other coin sensors such as coins sensor of automatic vending machines.

As has been described above, according to the present invention, diameter determination is performed on the basis of the ratio of the shielding time of two sensors of a plurality of optical sensors arranged to be vertical to the rolling path of coins. Therefore, measurement is performed at substantially the same time by the sensors, and no error is caused by a change in rolling speed. Since optical sensors need not be arranged to be spaced apart from each other in the rolling direction of coins as in the conventional device, the distance required for determination can be shortened, and a compact arrangement can be realized.

In addition, according to the present invention, since two sensors are selected from a plurality of optical sensors depending on the denomination of coin, a combination of sensors which can obtain the maximum ratio of shielding time can be selected, and the precision can be increased.

Further, according to the present invention, a measurement result of an element of a coin is converted into an address signal, and data which is stored in a memory in advance is read out by using the address signal so as to determine the coin. Therefore, discrimination of a coin denomination and an authentic coin can be performed.

Furthermore, according to the present invention, the diameter of a coin is discriminated by referring to different memory areas corresponding to ratios obtained in accordance with the presence/absence of detection time signals from an optical sensor located at an upper position. Therefore, an arrangement of a portion for converting a measurement signal into an address signal can be simplified.

Moreover, according to the present: invention, a digital drive signal for gradually increasing or decreasing the light emission amount of a light-emitting element is converted into an analog drive signal. This analog drive signal causes the light-emitting element to emit light. The light emitted from the light-emitting element is received and converted into a digital signal. When the digital signal reaches a predetermined level, the corresponding digital drive signal is stored. Therefore, an optical sensor can be driven with low power so as to ensure power for other control systems.

What is claimed is:

1. A coin diameter discriminating device, having an optical sensor arranged in a coin path on which an inserted coin rolls down, for discriminating a diameter of the coin on the basis of an output from said optical sensor, comprising:

a plurality of optical sensors arranged along the coin path so as to be separated from each other in a direction transverse to the coin rolling direction and to a direction of thickness of said coin;

measuring means for measuring a detection time of said coin to pass each said plurality of optical sensors;

calculating means for calculating a ratio of said detection times of two specific optical sensors from said plurality of optical sensors which are supplied by said measuring means; and discriminating means for discriminating a diameter of said inserted coin on the basis of said ratio calculations from said calculating means.

2. A device according to claim 1, further comprising a coin insertion detecting optical sensor positioned in said coin path upstream of said plurality of optical sensors;

said plurality of optical sensors being set in an active state when said insertion detecting optical sensor detects said coin insertion.

3. A device according to claim 1, wherein said discriminating means comprises:

address forming means for forming address data corresponding to the ratio obtained by said calculating means;

a memory for storing allowable data as bit correspondence data for each coin denomination; and means for accessing said memory in accordance with the address data so as to read out allowable data for each coin denomination.

4. A device according to claim 1, wherein each of said optical sensors is constituted by a light-emitting element and a light-receiving element, and further comprising control means for driving said light-emitting element to emit light and causing said light-receiving element which receives the emitted light to generate an output, said control means including a transistor driven by a drive signal, said control means comprising:

digital drive signal generating means for sequentially outputting a digital drive signal for gradually increasing and decreasing a light emission amount of said light-emitting element;

D/A-converting means for converting said digital drive signal from said digital drive signal generating means into an analog drive signal and supplying said analog drive signal to a base of said transistor;

A/D-converting means for receiving said analog signal output from said light-receiving element and converting said analog signal into a digital signal; and comparing means for comparing said digital signal from said A/D-converting means with a predetermined level and storing said digital drive signal when said digital signal reaches a predetermined level.

5. A coin diameter discriminating device according to claim 1, wherein said plurality of optical sensors comprises a first, second, and third optical sensor whereby absence of a detection time signal output from said first optical sensor activates said calculating means to calculate ratio detection times of said second and third optical sensors, and when said first optical sensor outputs a detection time signal, said calculating means calculates the ratio of said first detection time signal and one of said other optical sensors detection time signals.

6. A coin diameter discriminating device according to claim 5, wherein said discriminating means discrimination the diameter of said coin by referring to different memory areas corresponding to ratios obtained by said calculating means in accordance with the presence/absence of a detection time signal of said first optical sensor.

7. A coin diameter discriminating device according to claim 1, wherein said discriminating means comprises:

address forming means for forming address data corresponding to said ratio obtained by said calculating means;

a memory for storing allowable data or bit correspondence data for each coin denomination; and means for accessing said memory in accordance with said address data so as to read out allowable data for said coin denomination.

* * * * *

UNITED STATES PATENT AND TRADEMARK OFFICE

CERTIFICATE OF CORRECTION

PATENT NO. : 5,033,603

DATED : July 23, 1991

INVENTOR(S) : Kai et al

It is certified that error appears in the above-identified patent and that said Letters Patent is hereby corrected as shown below:

Column 1, line 16, delete "ar" and insert ---- are ----.

Column 2, line 22, delete "service" and insert ---- device ----.

Column 2, line 46, after "vention" insert a period ---- . ----.

Column 2, line 67, delete "t" and insert ---- to ----.

Column 3, line 59, after "shielded" insert ---- are ----.

Column 3, line 62, after "chart" insert a period ---- . ----.

Column 4, line 8, after "value" insert a period ---- . ----.

Column 4, line 10, after "109" insert a period ---- . ----.

Column 4, line 49, delete "i e.," and insert ---- i.e., ----.

Column 5, line 11, after "result" insert a period ---- . ----.

Column 6, line 24, delete "the" (second occurrence).

Column 6, line 25, after "of" insert ---- the ----.

Column 6, line 27, after "R1" insert a period ---- . ----.

Column 6, line 28, delete "comprises" and insert ---- constitutes ----.

Column 6, line 37, delete "comprises" and insert ---- includes ----.

UNITED STATES PATENT AND TRADEMARK OFFICE

CERTIFICATE OF CORRECTION

PATENT NO. : 5,033,603

DATED : July 23, 1991

INVENTOR(S) : Kai et al

It is certified that error appears in the above-identified patent and that said Letters Patent is hereby corrected as shown below:

Column 7, line 18, delete "(B" and insert ---- OB ----.

Column 7, line 19, after "values" insert a period ---- . ----.

Column 7, line 28, delete "b" and insert ---- d ----.

Column 7, line 61, delete "Yes" and insert ---- YES ----.

Column 8, line 55, after "present" delete the colon ":".

Column 10, line 28, delete "tion" and insert ---- tes ----.

Signed and Sealed this

Twenty-sixth Day of January, 1993

*Attest:*

STEPHEN G. KUNIN

*Attesting Officer*

*Acting Commissioner of Patents and Trademarks*